United States Patent [19]

Vazquez

[11] Patent Number: 4,970,984

[45] Date of Patent: Nov. 20, 1990

[54] MEMO MARKING STRIP

[76] Inventor: Santiago E. Vazquez, 2031 Sharpshire La., Arlington, Tex. 76014

[21] Appl. No.: 405,228

[22] Filed: Sep. 11, 1989

[51] Int. Cl.[5] ..... B42D 9/00

[52] U.S. Cl. ..... 116/234; 40/641; 283/38

[58] Field of Search ..... 116/234–235; 281/42; D19/34; 283/36–43; 40/359, 360, 641

[56] References Cited

U.S. PATENT DOCUMENTS

| | | | |
|---|---|---|---|
| 446,857 | 2/1891 | Fiske | 116/235 |
| 1,176,733 | 3/1916 | Campbell | 116/234 |
| 1,241,049 | 9/1917 | Stevens | 283/36 |
| 1,249,980 | 12/1917 | Mahan | 40/491 |
| 2,150,953 | 3/1939 | Washburn | 116/235 |
| 2,195,646 | 4/1940 | Green | 283/38 |
| 2,590,615 | 3/1952 | Heckendorn | 116/234 |
| 2,778,331 | 1/1957 | Bonilla | 116/234 |
| 2,984,205 | 5/1961 | Richards | 116/234 |
| 3,583,358 | 6/1971 | Hanson, Jr. | 116/235 |
| 4,175,777 | 11/1979 | Horn | 283/42 |

*Primary Examiner*—William A. Cuchlinski, Jr.
*Assistant Examiner*—W. Morris Worth
*Attorney, Agent, or Firm*—Jerry T. Kearns

[57] ABSTRACT

A memo marking strip for use in marking a place between pages of a document is formed from a thin elongated rectangular strip. The rectangular strip is preferably formed from a heavy gauge paper material and may be provided with various forms of writing guide line indicia to enable an individual to make notes thereon. Numeric indicia is provided on opposite faces of the strip in a manner to allow the numeric indicia to be displayed in an upright orientation from any edge of a document. The memo strip is preferably provided in a set of memo strips consisting of a plurality of different color groups, with the strips of each group being sequentially numbered.

18 Claims, 3 Drawing Sheets

MEMO MARKING STRIP

BACKGROUND OF THE INVENTION

1. Field of the Invention

The present invention relates to marking strips, and more particularly pertains to an improved memo marking strip and strip set which enables an individual to mark locations between pages of a document and to provide notes related to each location. Various types of marking strips have been proposed in the prior art for marking places in a book or document, however, these conventional marking strips do not bear numeric indicia in a manner which enables the indicia to be displayed in an upright position from any side edge of the document. Additionally, the prior art marking strips are not provided in a set consisting of sequentially numbered different color groups to provide a marking and not taking system. In order to overcome these problems, the present invention provides an improved memo marking strips and marking strip system which overcomes all of the deficiencies of the prior art marking strips.

2. Description of the Prior Art

Various types of marking strips are known in the prior art. A typical example of such a marking strip is to be found in U.S. Pat. No. 1,176,733, which issued to R. Campbell on Mar. 28, 1916. This patent discloses a book marker having a longitudinal bar on which a plurality of laterally extending tabs are slidably mounted. Numeric indicia is provided on an edge of each lateral tab to extend from a right hand edge of a book. U.S. Pat. No. 1,249,980, which issued to H. Mahan on Dec. 11, 1917, discloses an adjustable book mark record provided with adjustable numeric indicia displays for keeping track of various lesson assignments. U.S. Pat. No. 2,590,615, which issued to C. Heckendorn on Mar. 25, 1952, discloses a removable page and book mark having indicia for recording various emergency telephone numbers. U.S. Pat. No. 2,778,331, which issued to S. Bonilla on Jan. 22, 1957, discloses a book mark having a pair of slits forming movable flaps adapted to be received between the pages of a book. U.S. Pat. No. 2,984,205, which issued to U. Richards on May 16, 1961, discloses an automatic book mark including a foldable card having a plurality of folded flaps which automatically positions a marker between pages of a book upon book closing.

While the above mentioned devices are directed to various forms of marking strips, none of these devices disclose a memo marking strip which includes a plurality of numeric indicia oriented to allow selective display from top, bottom, left or right hand side edges of a book or document. Additional features of the present invention, not contemplated by the aforesaid prior art devices, include the provision of a set of memo marking strips consisting of a plurality of different pastel color groups, with each color group of strips bearing sequential numeric indicia oriented for selective display from top, bottom, left or right hand side edges of a book or document. Inasmuch as the art is relatively crowded with respect to these various types of marking strips, it can be appreciated that there is a continuing need for and interest in improvements to such marking strips, and in this respect, the present invention addresses this need and interest.

SUMMARY OF THE INVENTION

In view of the foregoing disadvantages inherent in the known types of marking strips now present in the prior art, the present invention provides an improved memo marking strip. As such, the general purpose of the present invention, which will be described subsequently in greater detail, is to provide a new and improved memo marking strip which has all the advantages of the prior art marking strips and none of the disadvantages.

To attain this, representative embodiments of the concepts of the present invention are illustrated in the drawings and make use of a memo marking strip, for use in marking a place between pages of a document, which is formed from a thin elongated rectangular strip. The rectangular strip is preferably formed from a heavy gauge paper material and may be provided with various forms of writing guide line indicia to enable an individual to make notes thereon. Numeric indicia is provided on opposite faces of the strip in a manner to allow the numeric indicia to be displayed in an upright orientation from any edge of a document. The memo marking strip is preferably provided in a set of memo marking strips consisting of a plurality of different color groups, with the strips of each group being sequentially numbered.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved memo marking strip which has all the advantages of the prior art marking strips and none of the disadvantages.

It is another object of the present invention to provide a new and improved memo marking strip which may be easily and efficiently manufactured and marketed.

It is a further object of the present invention to provide a new and improved memo marking strip which is of a durable and reliable construction.

An even further object of the present invention is to provide a new and improved memo marking strip which is susceptible of a low cost of manufacture with regard to both materials and labor, and which accordingly is then susceptible of low prices of sale to the consuming public, thereby making such marking strips economically available to the buying public.

Still yet another object of the present invention is to provide a new and improved memo marking strip which provides in the apparatuses and methods of the prior art some of the advantages thereof, while simultaneously overcoming some of the disadvantages normally associated therewith.

Still another object of the present invention is to provide a new and improved memo marking strip which may be selectively oriented to display numeric indicia in an upright orientation from top, bottom, left and right hand side edges of a book or document.

Yet another object of the present invention is to provide a new and improved set of memo marking strips to allow individuals to mark places in a book or document and to take appropriate notes in a systematic manner.

Even still another object of the present invention is to provide a new and improved memo marking strip system which utilizes a plurality of pastel color groups of memo strips, with strips of each color group bearing sequential numeric indicia to provide a convenient marking and note taking system.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
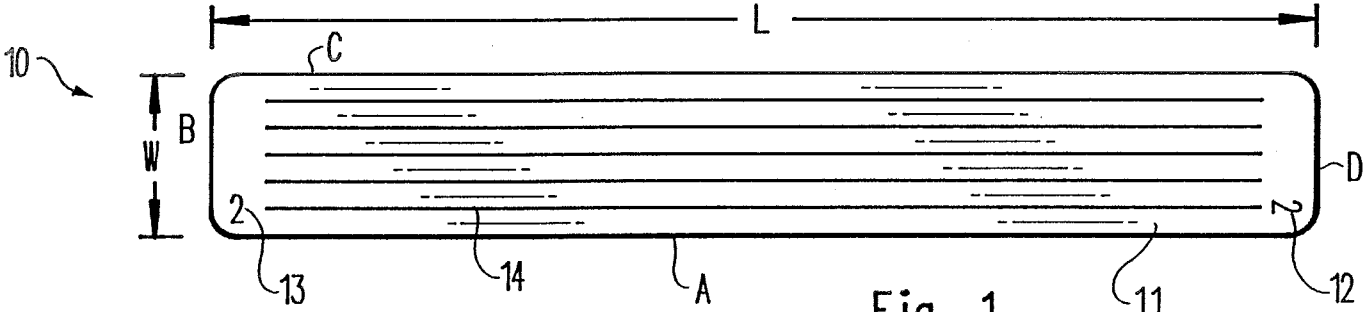
FIG. 1 is a plan view illustrating a first side face of a memo marking strip according to the present invention.

With reference now to the drawings, and in particular to FIG. 1 thereof, a new and improved memo marking strip embodying the principles and concepts of the present invention and generally designated by the reference numeral 10 will be described.

More specifically, it will be noted that the first embodiment 10 of the invention includes a thin elongated rectangular strip, preferably formed from a heavy gauge paper material, for example the type utilized to form manilla file folders. The strip 10 preferably has a length L of about ten inches and a width W of about one and one half inches. The strip 10 has two opposite side faces, a first of which, 11, is illustrated in FIG. 1. The side faces are defined by first A and second C elongated parallel side edges, which are connected at opposite ends by first B and second D end edges. The first B and second D end edges extend parallel to each other and perpendicular to the side edges A and C. The first side face 11 is provided with a first numeric indicia 13 located adjacent a corner portion formed by intersection of the first side edge A and the first end edge B. A second numeric indicia 12 is disposed adjacent a corner portion formed by intersection of the first side edge A and the second end edge D. The first 13 and second 12 numeric indicia are disposed at a ninety degree orientation relative to each other, for a purpose to be described subsequently.

Figure 2:
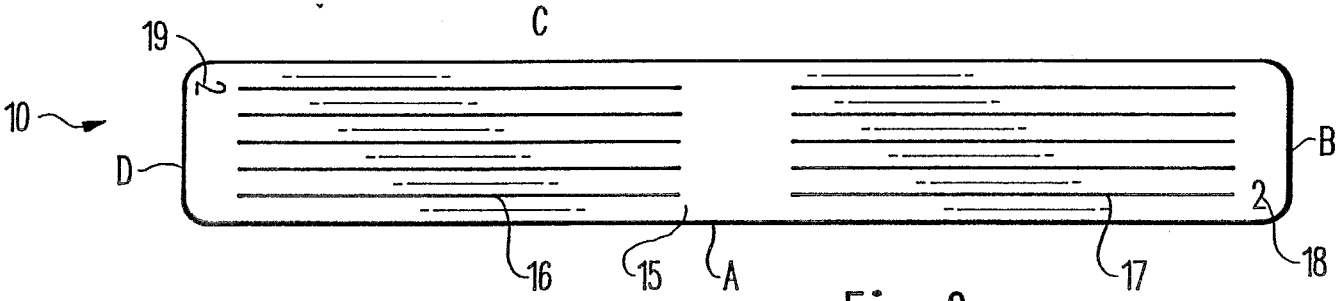
FIG. 2 is a plan view illustrating a second, opposite side face of the memo marking strip of FIG. 1.

As shown in FIG. 2, a second side face 15 is provided with a third numeric indicia 19 adjacent a corner portion formed by intersection of the second side edge C and the second end edge D. A fourth numeric indicia is disposed on the second side face 15, adjacent a corner portion formed by intersection of the first side edge A and the first end edge B. The third 19 and fourth 18 numeric indicia are disposed at a ninety degree orientation relative to each other. By rotating and flipping the memo marking strip 10 from side to side, one of the four numeric indicia 12, 13, 18 and 19 may be disposed in an upright orientation from a top, bottom, left or right side edge of a book or document.

Figure 3:
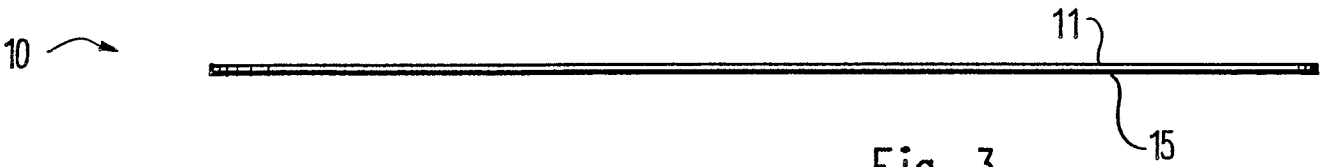
FIG. 3 is a side edge view illustrating the thickness of the memo marking strip of FIG. 1.

FIG. 3 is a side edge view which illustrates the thickness of the memo marking strip 10, which as described previously is preferably formed from a relatively heavy gauge paper material.

In addition to functioning as a book or place marker between the pages of a note pad, computer printout, textbook, or other document, the memo marking strip 10 may be provided with a variety of different forms of writing guide line indicia to enable individuals to conveniently make appropriate notations. As shown in FIG. 1, the writing guide line indicia may take the form of a plurality of elongated spaced parallel lines 14 which extend substantially along the length L of the strip 10.

Alternatively, as shown in FIG. 2, the writing guide line indicia may take the form of a plurality of spaced, parallel lines which extend substantially along the entire length of the strip 10, but are divided into left hand 16 and right hand 17 portions by a central blank strip or area formed centrally on one side face 15 of the memo marking strip 10.

Figure 4:
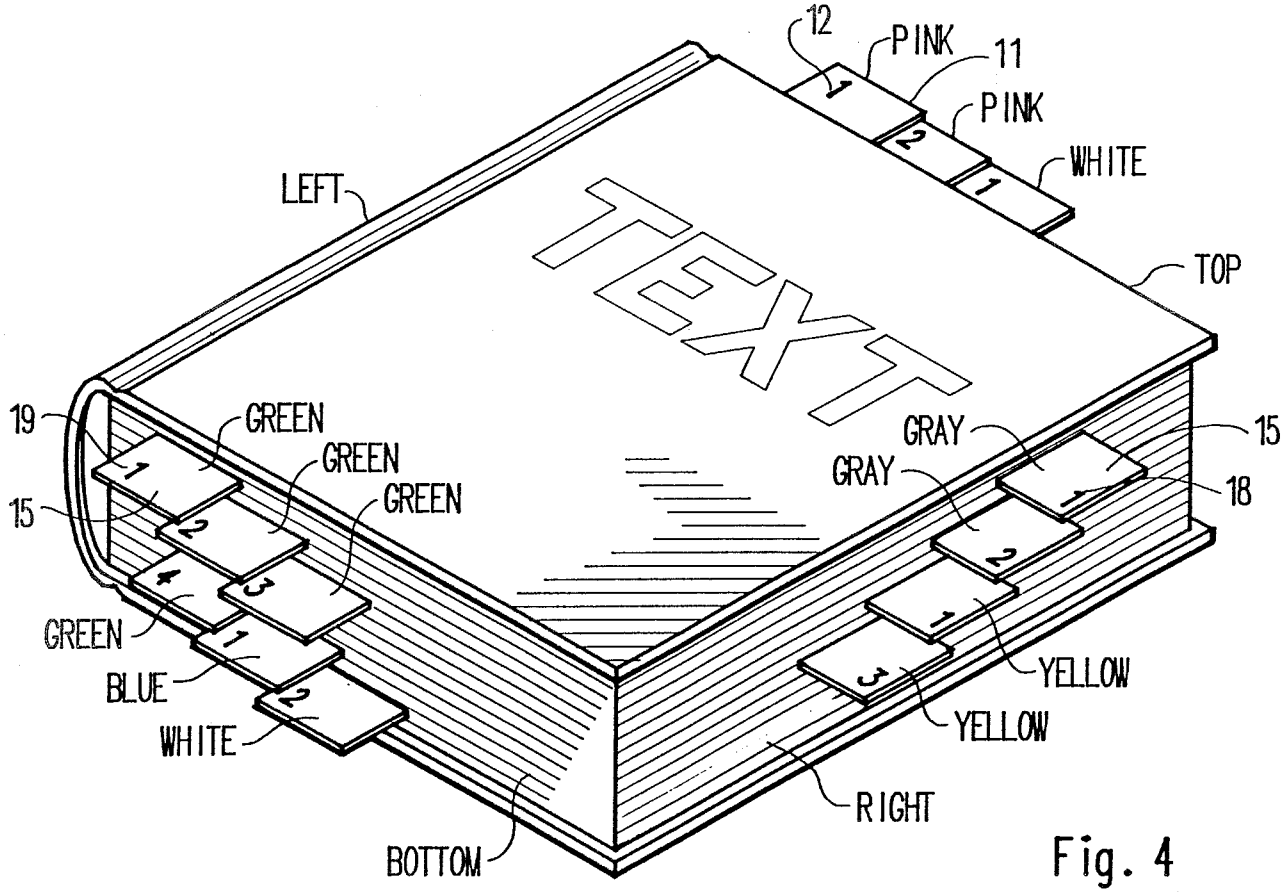
FIG. 4 is a perspective view illustrating the use of a set of memo marking strips according to the present invention to mark places between the pages of a document.

FIG. 4 is a perspective view which illustrates an example use of the memo marking strip system according to the present invention. The memo marking strips are preferably provided in a set consisting of a plurality of different light pastel groups, with the strips of each group bearing sequential numeric indicia. For example, pastel color groups may be selected from the pastel color set consisting of pink, white, green, gray, blue and yellow. These light pastel colors have been found to be easy on the eyes of a reader, so as not to induce visual stress. It should be noted that a variety of other different color combinations may be employed without departing from the scope of the present invention. As shown, a color group of GREEN strips bear sequential numeric indicia and may be employed to mark places in the text relating to common subject matter. The numeric indicia 19 is disposed in an upright orientation on the side face 15 of the GREEN strips and disposed adjacent the bottom edge of the text. Similarly, the GRAY and YELLOW strips are orientated with the numeric indicia 18 disposed in an upright orientation on the face 15 and placed to extend adjacent the right edge of the text. The PINK and WHITE strips are orientated with the face 11 disposed upwardly, with the numeric indicia 12 orientated in an upright orientation and extending adjacent the top edge of the text. While the strips have been illustrated in conjunction with a conventional book which is bound along the left edge, it should be noted that the memo marking strip system is adaptable for use in a note pad bound along a top edge, or a computer printout consisting of a plurality of overfolded sheets. In this case, the memo marking strip 10 may be orientated to dispose the face 11 in an upward orientation, with the numeric indicia 13 (FIG. 1) extending adjacent the left edge of the pad, document, or computer printout.

Figure 5:
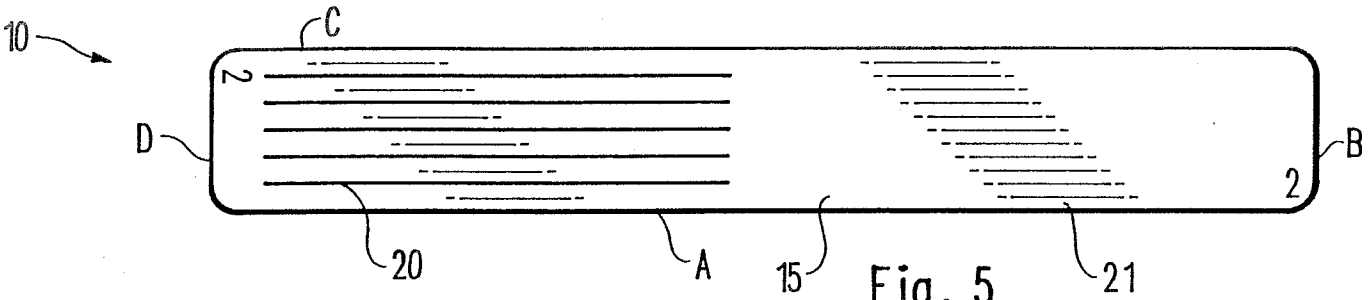
FIG. 5 is a plan view illustrating an alternative writing guide line form which may be provided on a side face of the memo marking strip of the present invention.

FIG. 5 is a plan view which illustrates an alternative form of guide lines which may be provided on the strip 10. A plurality of spaced parallel lines 20 extend along about half the length of the strip 10, leaving another half 21 of the strip 10 blank for use in making notations as deemed required by a user.

Figure 6:
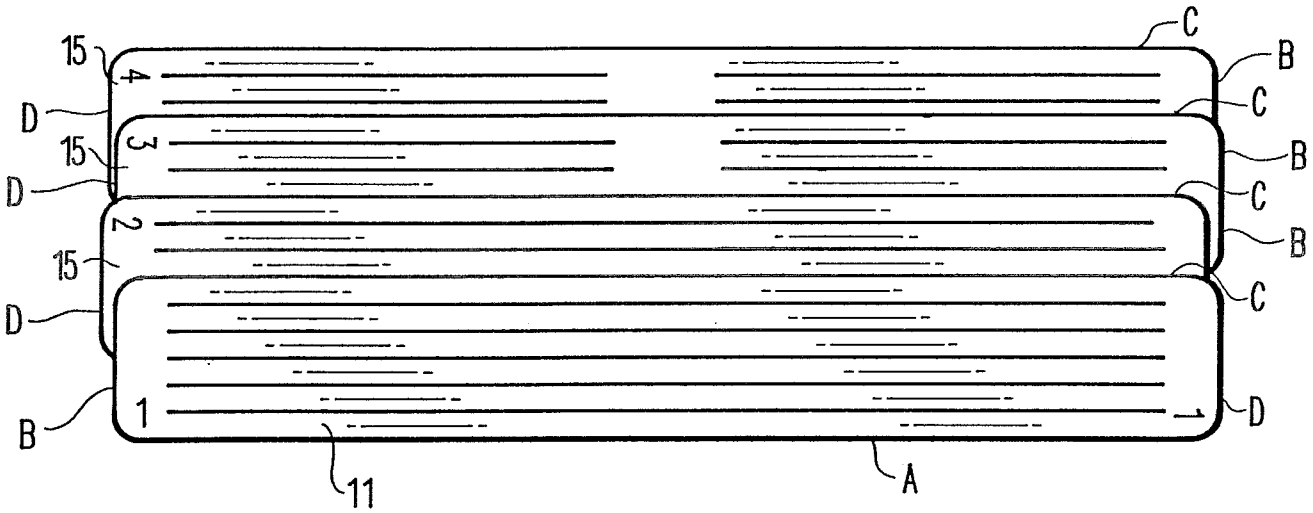
FIG. 6 is a plan view illustrating a set of sequentially numbered memo marking strips according to the present invention.

FIG. 6 illustrates an example set of memo marking strips, illustrating the sequential numbering thereon. While the set has been illustrated with only four strips, it is contemplated that a set of about thirty strips may be packaged in a single unit, and including five sequentially numbered strips in each of six different pastel color groups. To explain further, five strips will be pink and numbered sequentially from 1 through 5, five strips will be white and sequentially numbered 1 through 5, five strips will be green and sequentially numbered 1 through 5, five strips will be gray and sequentially numbered 1 through 5, five strips will be blue and sequentially numbered 1 through 5, and five strips will be yellow, and sequentially numbered 1 through 5. Additionally, the strips of each set may be provided on either or both of the opposite side faces with any of the three alternative guide line formations illustrated respectively in FIGS. 1, 2 and 5, or any combination thereof.

As may now be understood, the present invention provides a simple and inexpensive memo marking strip system for rapidly and conveniently marking places in a book, note pad, or business document and for providing appropriate associated notations.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A memo marking strip, comprising:

a thin elongated rectangular strip having two opposite side faces defined by first and second elongated parallel side edges connected at opposite ends by first and second end edges, said first and second end edges extending parallel to each other and perpendicular to said elongated side edges;

a first of said side faces having a first numeric indicia adjacent a corner portion formed by intersection of said first side edges and said first end edge;

a second numeric indicia on said first side face disposed adjacent a corner portion formed by intersection of said first side edge and said second end edge;

said first and second numeric indicia dipsosed at a 90 degree orientation relative to each other;

a second of said side faces having third numeric indicia adjacent a corner portion formed by intersection of said second side edge and said second end edge;

a fourth numeric indicia on said second side face disposed adjacent a corner portion formed by intersection of said first side edge and said first end edge;

and said third and fourth numeric indicia disposed at a 90 degree orientation relative to each other, whereby said memo marking strip may be oriented between pages of a document to selectively display said first numeric indicia in an upright position on a left hand edge of said document, or said second numeric indicia in an upright orientation on a top edge of said document, or said third numeric indicia in an upright orientation on a bottom edge of said document, or said fourth numeric indicia in an upright orientation on a right side edge of said document.

2. The memo marking strip of claim 1, wherein said memo marking strip is formed from a heavy gauge paper material.

3. The memo marking strip of claim 1, wherein said memo strip has a light pastel color selected from the group of pink, white, green, gray, blue and yellow.

4. The memo marking strip of claim 1, further comprising a plurality of said memo marking strips forming a set, said memo marking strips in said set bearing sequential numeric indicia.

5. The memo marking strip of claim 1, further comprising a plurality of said memo marking strips forming a set, said set of memo marking strips consisting of a plurality of differently colored groups of memo marking strips, memo marking strips in each color group bearing sequential numeric indicia.

6. The memo marking strip of claim 1, further comprising writing guide line indicia on said first and second side faces of said memo marking strip.

7. The memo marking strip of claim 6, wherein said writing guide line indicia comprises a plurality of spaced lines extending in parallel relation along the length of said memo marking strip.

8. The memo marking strip of claim 6, wherein said writing guide line indicia comprises a plurality of spaced lines extending in parallel relation about half the length of said memo marking strip.

9. The memo marking strip of claim 6, wherein said writing guide line indicia comprises a plurality of spaced lines extending in parallel relation along the length of said memo marking strip, each of said lines divided into separate right and left hand portions by a central blank space on said memo marking strip.

10. A method of marking a place between pages of a document, comprising the steps of: providing:

a thin elongated rectangular strip having two opposite side faces defined by first and second elongated parallel side edges connected at opposite ends by first and second end edges, said first and second end edges extending parallel to each other and perpendicular to said elongated side edges;

a first of said side faces having a first numeric indicia adjacent a corner portion formed by intersection of said first side edge and said first end edge;

a second numeric indicia on said first side face disposed adjacent a corner portion formed by intersection of said first side edge and said second end edge;

said first and second numeric indicia disposed at a 90 degree orientation relative to each other;

a second of said side faces having third numeric indicia adjacent a corner portion formed by intersection of said second side edge and said second end edge;

a fourth numeric indicia on said second side face disposed adjacent a corner portion formed by intersection of said first side edge and said first end edge;

said third and fourth numeric indicia disposed at a 90 degree orientation relative to each other;

and selectively orienting said memo marking strip between pages of a document to display said first numeric indicia in an upright position on a left hand edge of said document, or said second numeric indicia in an upright orientation on a top edge of said document, or said third numeric indicia in an upright orientation on a bottom edge of said document, or said fourth numeric indicia in an upright orientation on a right side edge of said document.

11. The method of claim 10, wherein said memo marking strip is formed from a heavy gauge paper material.

12. The method of claim 10, wherein said memo marking strip has a light pastel color selected from the group of pink, white, green, gray, blue and yellow.

13. The method of claim 10, further comprising the step of providing:

a plurality of said memo marking strips forming a set, said memo marking strips in said set bearing sequential numeric indicia.

14. The method of claim 10, further comprising the step of providing:

a plurality of said memo marking strips forming a set, said set of memo marking strips consisting of a plurality of differently light colored groups of memo marking strips, memo marking strips in each color group bearing sequential numeric indicia.

15. The method of claim 10, further comprising the step of providing:

writing guide line indicia on said first and second side faces of said memo marking strip.

16. The method of claim 15, wherein said writing guide line indicia comprises a plurality of spaced lines extending in parallel relation along the length of said memo marking strip.

17. The method of claim 15, wherein said writing guide line indicia comprises a plurality of spaced lines extending in parallel relation about half the length of said memo marking strip.

18. The method of claim 15, wherein said writing guide line indicia comprises a plurality of spaced lines extending in parallel relation along the length of said memo marking strip, each of said lines divided into separate right and left hand portions by a central blank space on said memo marking strip.

* * * * *